US010508660B2

(12) United States Patent
Hall et al.

(10) Patent No.: US 10,508,660 B2
(45) Date of Patent: Dec. 17, 2019

(54) APPARATUS AND METHOD FOR POSITIONING A VARIABLE VANE

(71) Applicants: Rolls-Royce Corporation, Indianapolis, IN (US); Rolls-Royce North American Technologies Inc., Indianapolis, IN (US)

(72) Inventors: Christopher Hall, Indianapolis, IN (US); Russell White, Indianapolis, IN (US); Jonathan Acker, Westfield, IN (US); Lyle Helvie, Mooresville, IN (US)

(73) Assignees: Rolls-Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 173 days.

(21) Appl. No.: 15/789,456

(22) Filed: Oct. 20, 2017

(65) Prior Publication Data

US 2019/0120250 A1 Apr. 25, 2019

(51) Int. Cl.
*F04D 29/56* (2006.01)
*F04D 29/64* (2006.01)

(52) U.S. Cl.
CPC ..... *F04D 29/563* (2013.01); *F04D 29/644* (2013.01)

(58) Field of Classification Search
CPC ..... F04D 29/563; F04D 29/644
USPC ..... 415/1
See application file for complete search history.

(56) References Cited

U.S. PATENT DOCUMENTS

| | | | | |
|---|---|---|---|---|
| 2,936,108 | A | 5/1960 | Balcom et al. | |
| 3,334,521 | A | 8/1967 | Kast | |
| 5,993,152 | A | 11/1999 | Schilling | |
| 6,769,868 | B2 | 8/2004 | Harrold | |
| 7,273,346 | B2 | 9/2007 | Bourn | |
| 8,727,697 | B2 | 5/2014 | Eifert | |
| 2009/0226305 | A1* | 9/2009 | Wong | F01D 17/162 415/160 |
| 2013/0210572 | A1* | 8/2013 | Coles | F01D 17/20 475/331 |

FOREIGN PATENT DOCUMENTS

| | | |
|---|---|---|
| GB | 2119862 | 11/1983 |

* cited by examiner

*Primary Examiner* — Joseph J Dallo
*Assistant Examiner* — Yi-Kai Wang
(74) *Attorney, Agent, or Firm* — McCracken & Gillen LLC

(57) ABSTRACT

An apparatus and method of controlling the position of a variable vane in a compressor and a kit for adding such apparatus to the compressor are disclosed. The vane is coupled to a unison ring, a cam is secured to a torque tube, a cam follower is secured to the unison ring. The cam follower is secured such that a wall of the cam follower is in contact with the cam. Rotation of the torque tube causes movement of the cam, and movement of the cam moves the cam follower, thereby moving the unison ring and the variable vane coupled thereto.

20 Claims, 8 Drawing Sheets

APPARATUS AND METHOD FOR POSITIONING A VARIABLE VANE

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

FIELD OF DISCLOSURE

The present subject matter relates to turbine engines, and more particularly, to a variable vane positioning system for use in a compressor of a turbine engine.

BACKGROUND

A gas turbine engine, for example, a turbofan jet engine, includes a fan coupled to a shaft. As the fan rotates, ambient air is drawn into the engine through an inlet thereof. A portion of the drawn air passes through a bypass flow path and escapes through an exhaust port of the engine and creates thrust that propels a vehicle. Another portion of the drawn air is directed through one or more compressors that compress and pressurize the air. The compressed air is directed to a combustor in which the compressed air is combined with a fuel and ignited. Such ignition causes combustion of the fuel and the compressed air, and produces rapidly expanding gasses. The gasses pass through a turbine that includes one or more turbine stages coupled to the shaft, and are exhausted through the exhaust port. The gasses rotate the turbine, which then causes the shaft to rotate. Rotation of the shaft rotates the fan to draw in more ambient air into the inlet port of the engine.

The compressor of the engine may include a combination of axial and centrifugal compressors. The airflow through the axial compressor is generally parallel to the shaft coupled to the axial compressor, and the airflow through the centrifugal compressor is generally perpendicular to the shaft. Both types of compressors include rotatable components that are coupled to the shaft.

The axial compressor includes one or more rotor stages interleaved with one or more stator stages. Each such stator stage includes one or more vanes. In some engines, the pitch of the vanes in each stage relative to the airflow through the axial compressor is varied in accordance with the rotational speed of the rotor stages. In some such engines, the vanes of a particular stage are coupled to a unison ring that surrounds a casing of the compressor. The vanes are coupled to the unison ring such that rotation of the unison ring circumferentially about the casing causes a local rotation of the vanes attached thereto. Different techniques may be used to rotate the unison ring. Some techniques employ a torque tube coupled to the unison rings associated with the different stator stages for the compressor by a lever. In such techniques, however, actuation of the torque tube causes all of the unison rings coupled thereto to move in synchrony for a uniform distance and at a constant velocity. Therefore, the vanes of the different stator also rotate a proportional amount, but at a constant velocity in response to a particular amount of rotation of the torque tube.

SUMMARY

According to one aspect, a variable vane positioning apparatus for controlling the position of a variable vane of a stator in a compressor of a turbine engine includes a unison ring, a torque tube, a cam follower, and a cam. The vane is coupled to the unison ring via a vane arm, the cam is secured to a torque tube, and the cam follower is secured to the unison ring and has a wall in contact with the cam. Rotation of the torque tube causes movement of the cam, and movement of the cam moves the cam follower, and movement of the cam follower moves the unison ring and the variable vane coupled thereto.

According to another aspect, a method of positioning a variable vane in a compressor of a turbine engine, wherein the variable vane is coupled to a unison ring, includes the steps of rotating a torque tube, moving a cam secured to the torque tube in response to rotating the torque tube, and moving a cam follower in contact with the cam in response to moving the cam follower, wherein the cam follower is secured to the unison ring. The method also includes the step of, in response to movement of the cam follower, moving the unison ring and the vane.

According to yet another aspect, a kit for adding a variable vane control to a compressor of a turbine engine, wherein the compressor includes a variable vane coupled to a unison ring, includes a cam follower, a cam, a fastener to mechanically secure the cam to a torque tube, and a fastener to mechanically secure the cam follower to a unison ring and in contact with the cam. Rotation of the torque tube results in a movement of the unison ring via the cam and the cam follower.

Other aspects and advantages will become apparent upon consideration of the following detailed description and the attached drawings wherein like numerals designate like structures throughout the specification.

DETAILED DESCRIPTION

Figure 1:
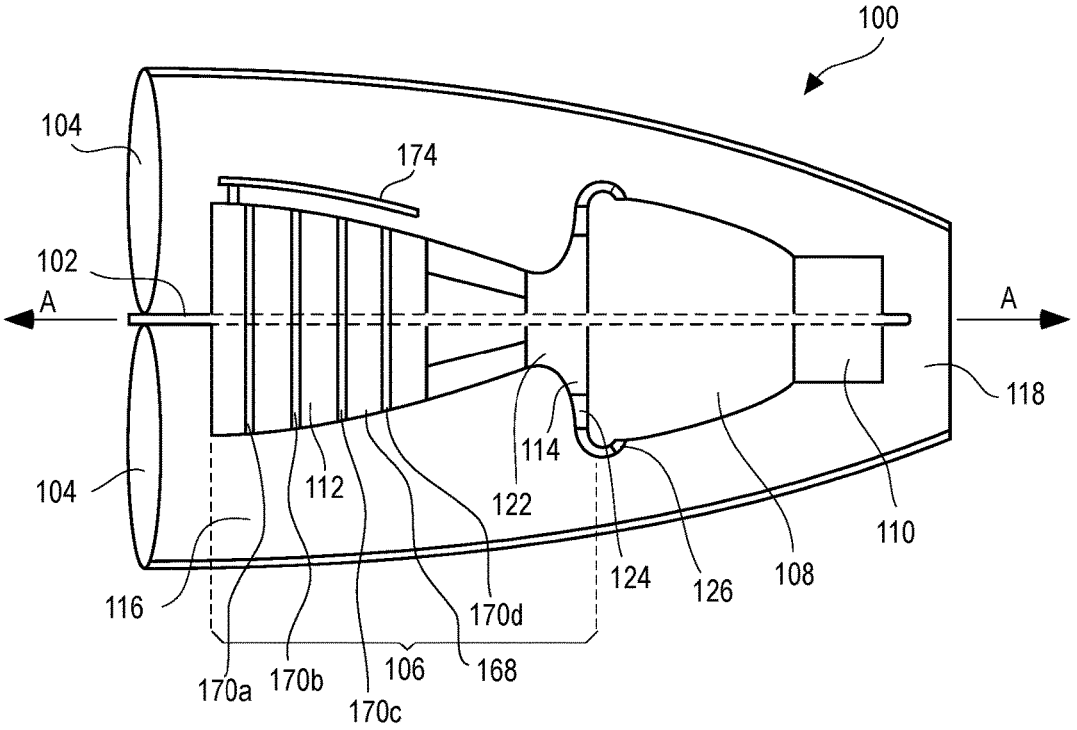
FIG. 1 is a cross-sectional view of an exemplary turbofan engine.

Referring to FIG. 1, an engine 100 includes a shaft 102, a fan 104, a compressor 106, a combustor 108, and a turbine 110. The compressor 106 includes an axial compressor 112 and a centrifugal compressor 114.

The turbine 110 is coupled to the shaft 102 so that rotation of the turbine 110 causes rotation of the shaft 102. In some embodiments, the axial compressor 112 and the centrifugal compressor 114 are all also coupled to and driven by the shaft 102 such that, when the shaft 102 rotates, both compressors 112, 114 rotate at the same speed as the shaft 102 and the turbine 110. In other embodiments, the fan 104, the axial compressor 112, and the centrifugal compressor 114 are coupled to one or more other shafts (not shown), which in turn are driven by the shaft 102. In these embodiments, one or more of the fan 104, the axial compressor 112, and the centrifugal compressor 114 may rotate at speeds different from one another and different than the shaft 102.

When the fan 104 rotates, air is drawn into the engine 100. A portion of the drawn air passes through a bypass flow path 116 to an output port 118 of the engine 100, and thereby generates thrust.

Another portion of the drawn air is directed through the axial compressor 112, and compressed air from the axial compressor 112 is passed into the centrifugal compressor 114.

The centrifugal compressor 114 includes an impeller 122, a diffuser 124, and one or more de-swirl vanes 126. Compressed air enters the impeller 122, passes through the diffuser 124 and the de-swirl vanes 126 and into the combustor 108. The compressed air is combined with a fuel in the combustor 108 and burned to produce rapidly expanding combustion gasses. The combustion gasses pass through and rotate the turbine 110. Because the turbine 110 is coupled to the shaft 102, rotation of the turbine 110 causes rotation of the shaft 102, and thereby rotation of the fan 104 to draw in more air. After passing through the turbine 110, the combustion gasses are exhausted through the output port 118 and provide additional thrust.

Figure 2:
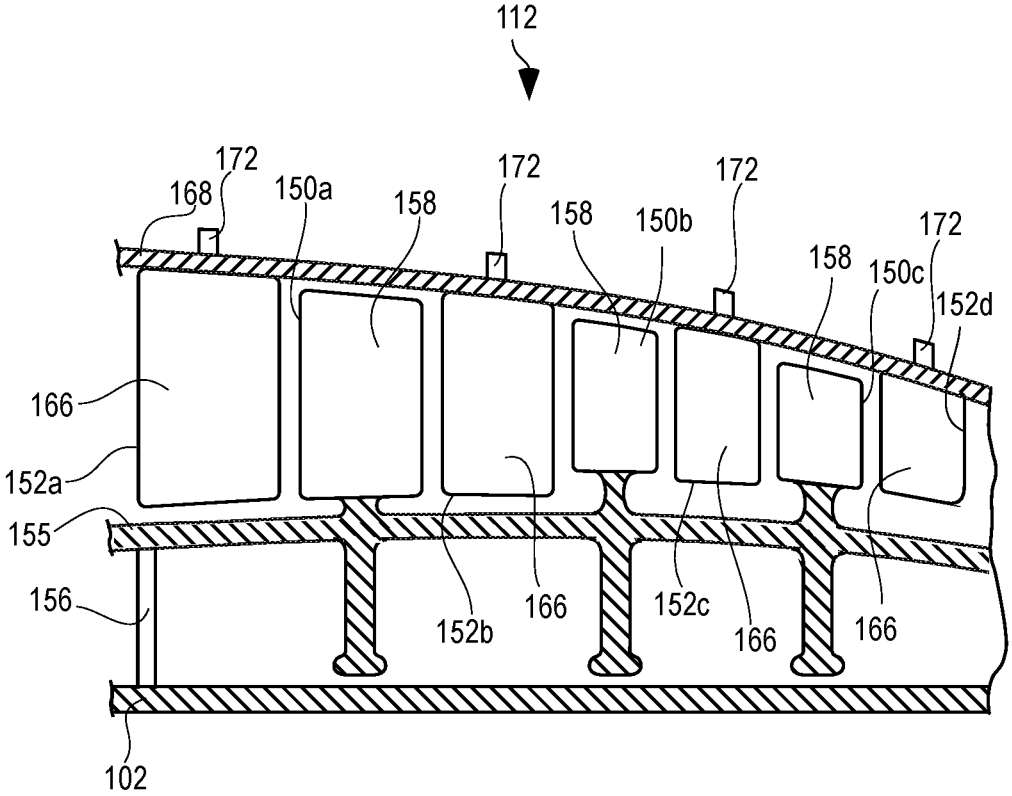
FIG. 2 is a cross-sectional fragmentary view of an axial compressor of the engine of FIG. 1, with a portion of the compressor in side elevational view.

Referring to FIGS. 1 and 2, the axial compressor 112 includes a plurality of spaced rotors 150*a*, 150*b*, and 150*c* interleaved with a plurality of spaced stators (or stator stages) 152*a*, 152*b*, 152*c*, and 152*d*. Although the embodiment of the axial compressor 112 shown in FIG. 2 includes three rotors 150 interleaved with four stators 152 other embodiments of the axial compressor 112 may have more or fewer rotors 150 and stators 152. In some embodiments, the number of rotors 150 is identical to the number of stators 152. Alternately, the number of rotors 150 may be different than the number of stators 152.

Figure 3:
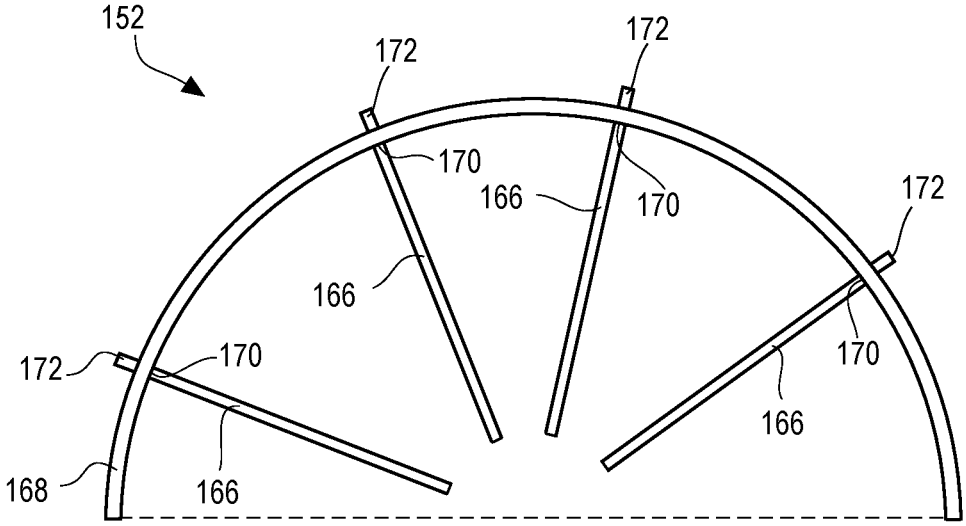
FIG. 3 is an elevational view of a portion of a stator of the axial compressor of FIG. 2

Referring to FIGS. 1-3, each stator 152 includes a plurality of stator vanes 166 supported in an outer casing 168 of the compressor 112. In particular, a radially outer end 170 of the stator vane 166 is secured to a spindle 172, and the spindle 172 is passed through the outer casing 168. The spindles 168 of each stator 152*a*, 152*b*, 152*c*, and 152*d* are mechanically coupled to a unison ring 170*a*, 170*b*, 170*c*, and 170*d* (FIG. 1) via vane arms (not shown), respectively, associated with such stator 152. The unison rings 170*a*, 170*b*, 170*c*, and 170*d* surround the outer casing 168 and are mechanically coupled to a torque tube 174 (FIG. 1). The torque tube 174 may be secured to the outer casing 168 or to another static portion of the engine 100.

As is described below, rotation of the torque tube 174 causes the unison rings 170*a*, 170*b*, 170*c*, and 170*d* coupled thereto to rotate about a central axis A-A of the outer casing 168 (i.e., circumferentially about the casing). Further, rotation of a particular unison ring 170*a*, 170*b*, 170*c*, or 170*d* causes the spindles 172 coupled to the particular unison ring 170*a*, 170*b*, 170*c*, or 170*d* to also rotate about an axis perpendicular the axis A-A (i.e., radially), and thereby causes the vanes 166 coupled to the spindles 172 to rotate about the spindle 172, and thereby vary the pitch angle of such vanes 166 relative to the airflow through the compressor 116.

Figure 4:
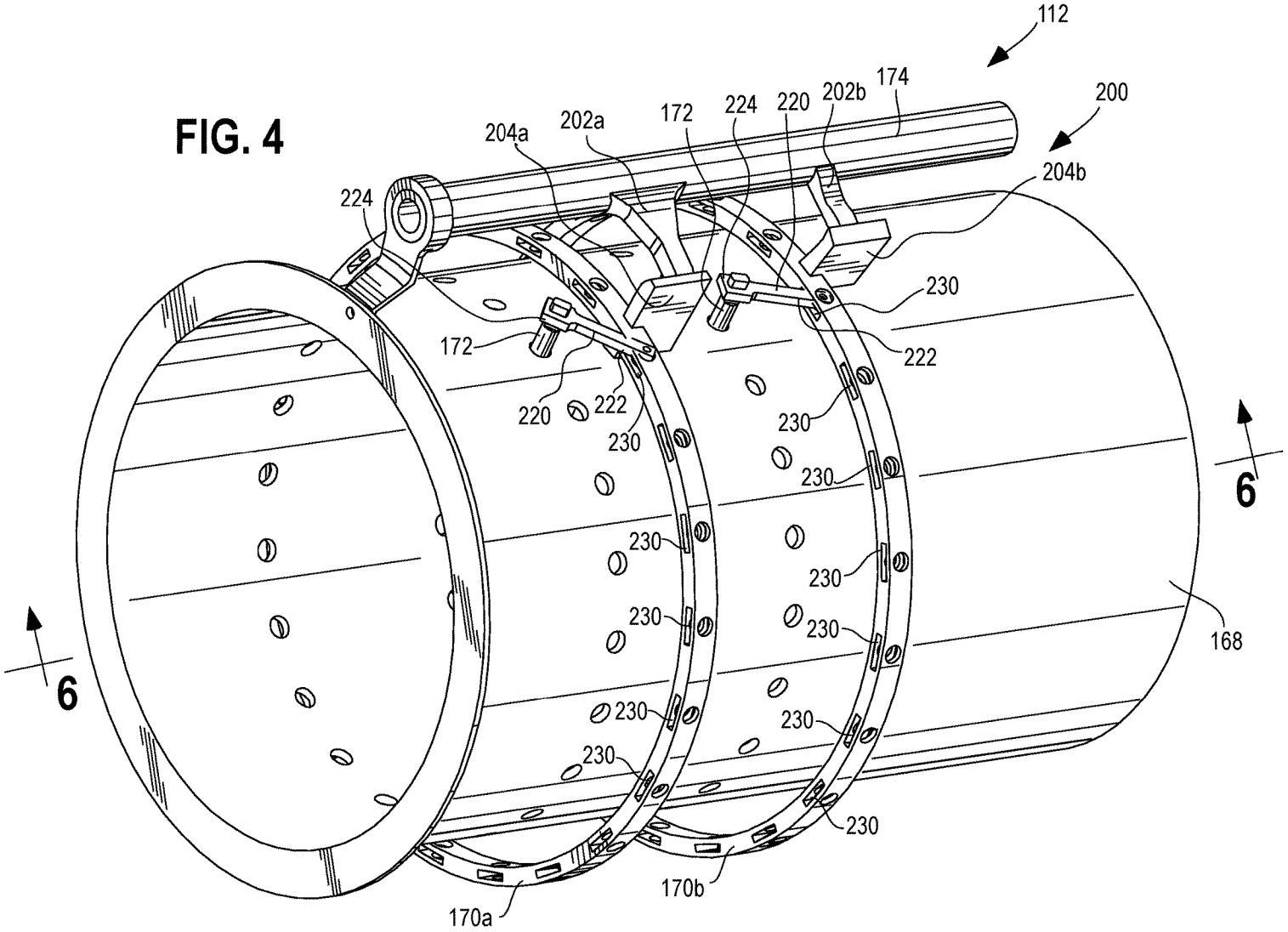
FIG. 4 is an isometric view of portions of the axial compressor of FIG. 2 that shows a variable vane positioning apparatus.
Figure 5:
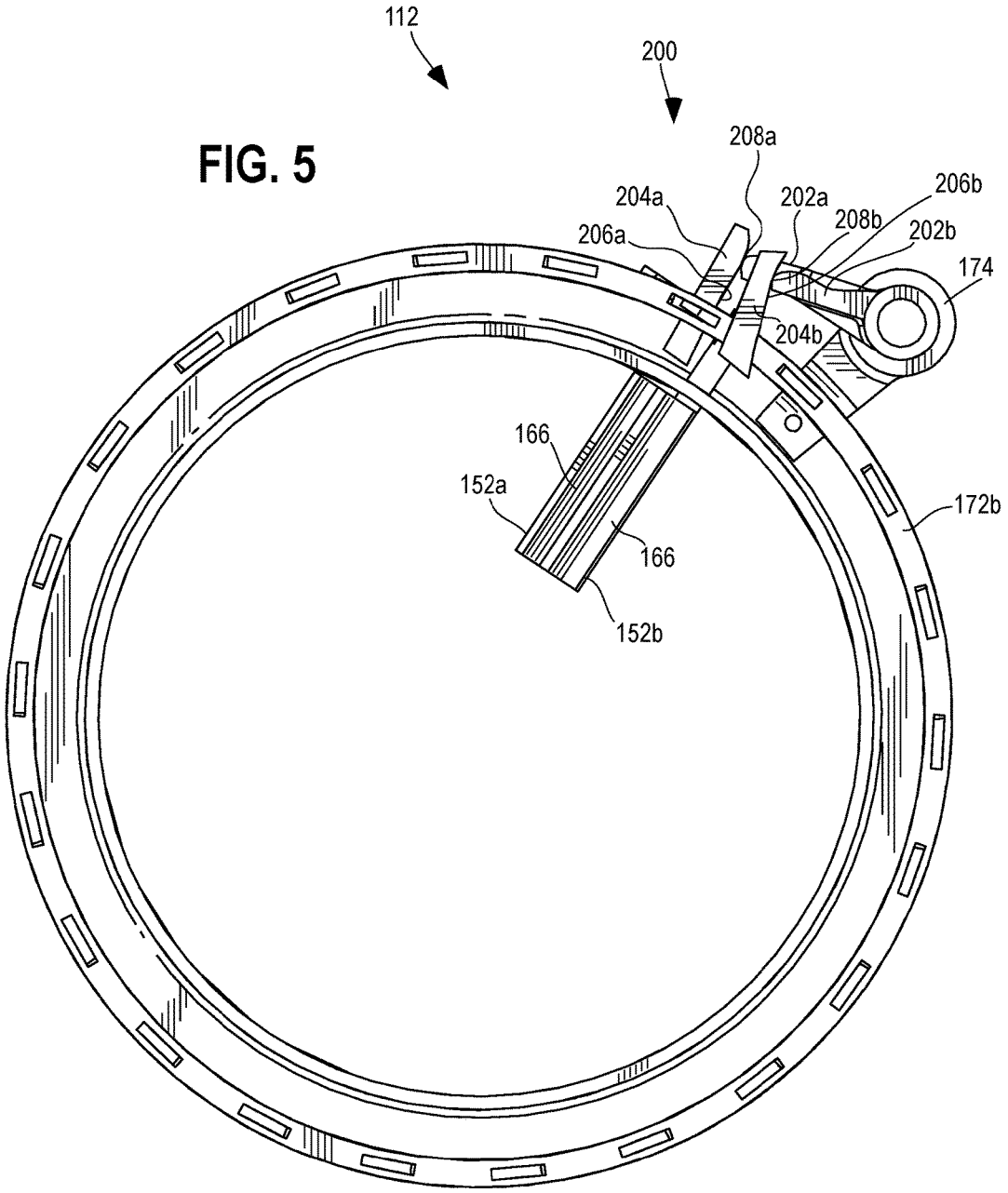
FIG. 5 is an elevational view of portions of the axial compressor of FIG. 2 that shows the variable vane positioning apparatus.
Figure 6:
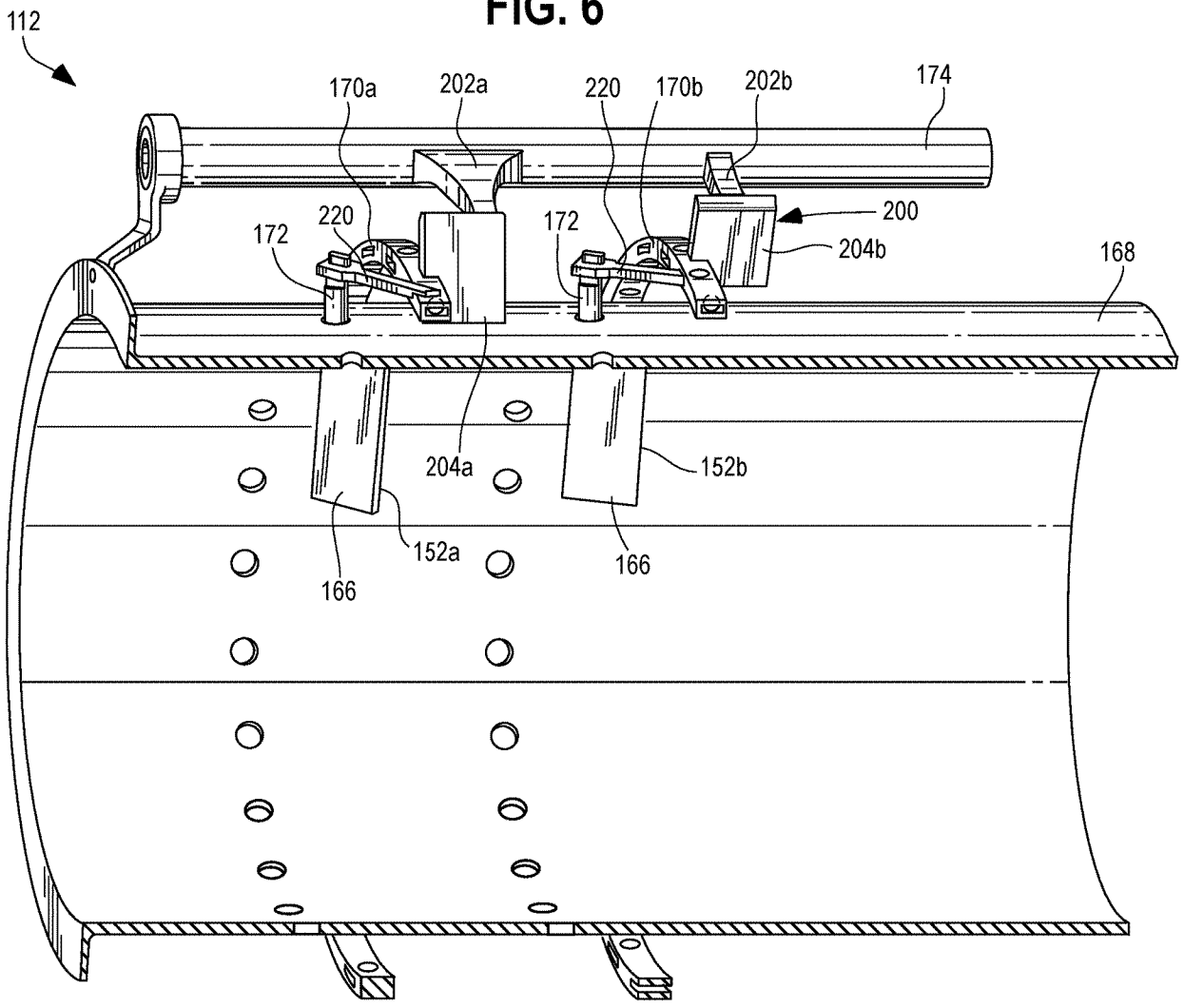
FIG. 6 is a cross-sectional view of portions of the axial compressor of FIG. 2 taken along the line 6-6 of FIG. 4 and that shows the variable vane positioning apparatus.
Figure 7:
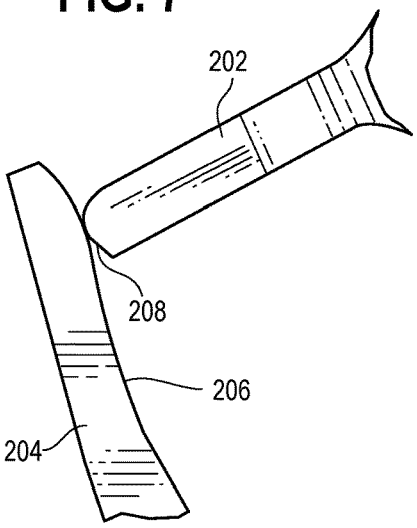
FIG. 7 is an elevational view of a cam and cam follower of the variable vane positioning apparatus of FIGS. 4-6.

FIGS. 4-6 show an exemplary embodiment of a variable vane positioning apparatus 200 of an axial compressor 112 that may be used to adjust a pitch of the vanes 166 of the stators 152 of such compressor. To better illustrate the variable vane position apparatus 200, only two stators 152*a* and 152*b*, and two unison rings 170*a* and 170*b*, are shown. Further, only one vane 166 of each stator 152*a* and 152*b* is shown. It should be apparent that the variable vane positioning apparatus 200 may be used with any number unison rings 170, each associated with a corresponding stator 152. Further, each stator 152 may include any number of vanes therein 166 therein.

Referring to FIGS. 4-6, the vane positioning apparatus 200 includes a cam 202 and a cam follower 204 associated with each unison ring 170. Each cam 202*a* and 202*b* is secured to the torque tube 174, and each cam follower 204*a* and 204*b* is secured to the unison ring 170*a* and 170*b*, respectively, associated therewith. The cam 202 may be fastened to the torque tube by one or more fasteners. Alternatively, the cam 202 may be welded or adhered to the torque tube 174. In an exemplary embodiment, the cam 202 is removeably fastened to the torque tube 174 so that the cam 202 may be replaced when damaged, removed for maintenance, or replaced with a cam 202 having a different shape. The cam follower 204 may be fastened to the unison ring 170 by welding and/or using one or more fasteners and/or an adhesive. In an exemplary embodiment, the cam follower 204 is removeably fastened to the unison ring 170. The cam 202 and the cam follower 204 may be made of any durable material suitable for use in an engine environment including a thermoplastic material, a metal, and the like.

Referring also to FIG. 6 and described further below, a face 206 of each cam follower 204 is urged against a terminal portion 208 of the cam 202 associated therewith.

Rotation of the torque tube 174 causes each cam 202 secured thereto to rotate (i.e., move) therewith. Because the face 206 of the cam follower 204 is urged against the terminal portion 208 of the cam 202, the length of the cam 202, an angle between the cam 202 and the torque tube 174, and a profile of the face 206 combine to determine the distance the cam follower 204 travels (i.e., moves) toward or away from the torque tube 174, and a velocity of such travel, in response to a particular angular rotation and velocity of the torque tube 174. In addition, a profile of the terminal portion 208 of the cam 202 in contact with the face 206 of the cam follower 204 also influences such distance and velocity of the cam follower 204. Because rotation of the cam 202, causes the terminal portion 208 thereof to slide along the face 206 of the cam follower 204, variations in the profile of the face 206 vary the velocity at which the cam follower 204 moves even as the torque tube 174 rotates at a constant speed.

Further, because the unison ring 170 is secured to the cam follower 204, the distance and velocity of the cam follower 204 toward or away from the torque tube 174 also determines a distance the unison ring 170 travels (i.e., moves) about the outer casing 168, and the velocity of such travel, in response to the particular rotation of the torque tube 174 at the particular velocity. Further, as described above in connection with the velocity of the movement of the cam follower 204, the velocity of the movement of the unison ring 170 varies in accordance with the profile of the face 206 of the cam follower 204 even as the torque tube 174 rotates at a constant speed.

The profiles of the face 206 of each cam follower 204*a* and 204*b*, the lengths of the cams 202*a* and 202*b*, the angles of the cams 202*a* and 202*b* relative to the torque tube, and the profiles of the terminal portions 208 of the cams 202*a* and 202*b*, can be selected to vary the distance traveled and velocity of such travel of the unison ring 170*a* and 170*b*, respectively, in response to a particular angular rotation and velocity of the torque tube 174.

Referring still to FIGS. 4-6, in one embodiment, each unison ring 170 includes a plurality of vane arms or levers 220. One end 222 of each lever 220 is pivotally secured to the unison ring 170, and another end of the 224 is immovably secured to the spindle 172 of a vane 166 of the stator associated with the unison ring 170. Rotation of the unison ring 170 causes the lever 220 to pivot in the unison ring 170, and thereby cause rotation of the spindle 172 and the vane 166 attached thereto. In this manner, the positions of all of the vanes 166 of the stator 152*a* associated with the unison ring 170*a* may be adjusted simultaneously in accordance with the distance, direction, and velocity with which the unison ring 170*a* is rotated. Similarly, the positions of all of the vanes 166 of the stator 152*b* associated with the unison ring 170*b* may be adjusted simultaneously in accordance with the direction, distance, and velocity with which the unison ring 170*b* is rotated. Thus, a magnitude and rate at which the positions of the vanes 166 of the stator 152*a* are changed may be different than a magnitude and rate at which the positions of the vanes 166 of the stator 152*b* depending on: the lengths of the cams 202*a* and 202*b*, respectively; the angles at which the cams 202*a* and 202*b*, respectively, protrude from the torque tube 174; the profiles of the terminal portions 208 of the cams 202*a* and 202*b*, respectively; and the profiles of the faces 206 of the cam followers 204*a* and 204*b*, respectively.

In one embodiment, the unison ring 170 has a plurality of slots 230 around the circumference thereof, one slot 230 for each vane 166 controlled by the unison ring 170. The end 222 of the lever 220 is pivotally captured in such slot 230, for example, by passing a bolt (not shown) through an aperture (not shown) disposed in the end 222. Any suitable fasteners to pivotally secure the end 222 of the lever 220 in the unison ring 170 apparent to those who have skill in the art may be used.

For the variable vane apparatus 200 to function properly, the face 206 of the cam follower 204 and the terminal portion 208 of the cam 202 should remain in substantially continuous contact. Different ways of maintaining such contact are described below. However, any other suitable way of maintaining such contact may be employed.

Figure 8:
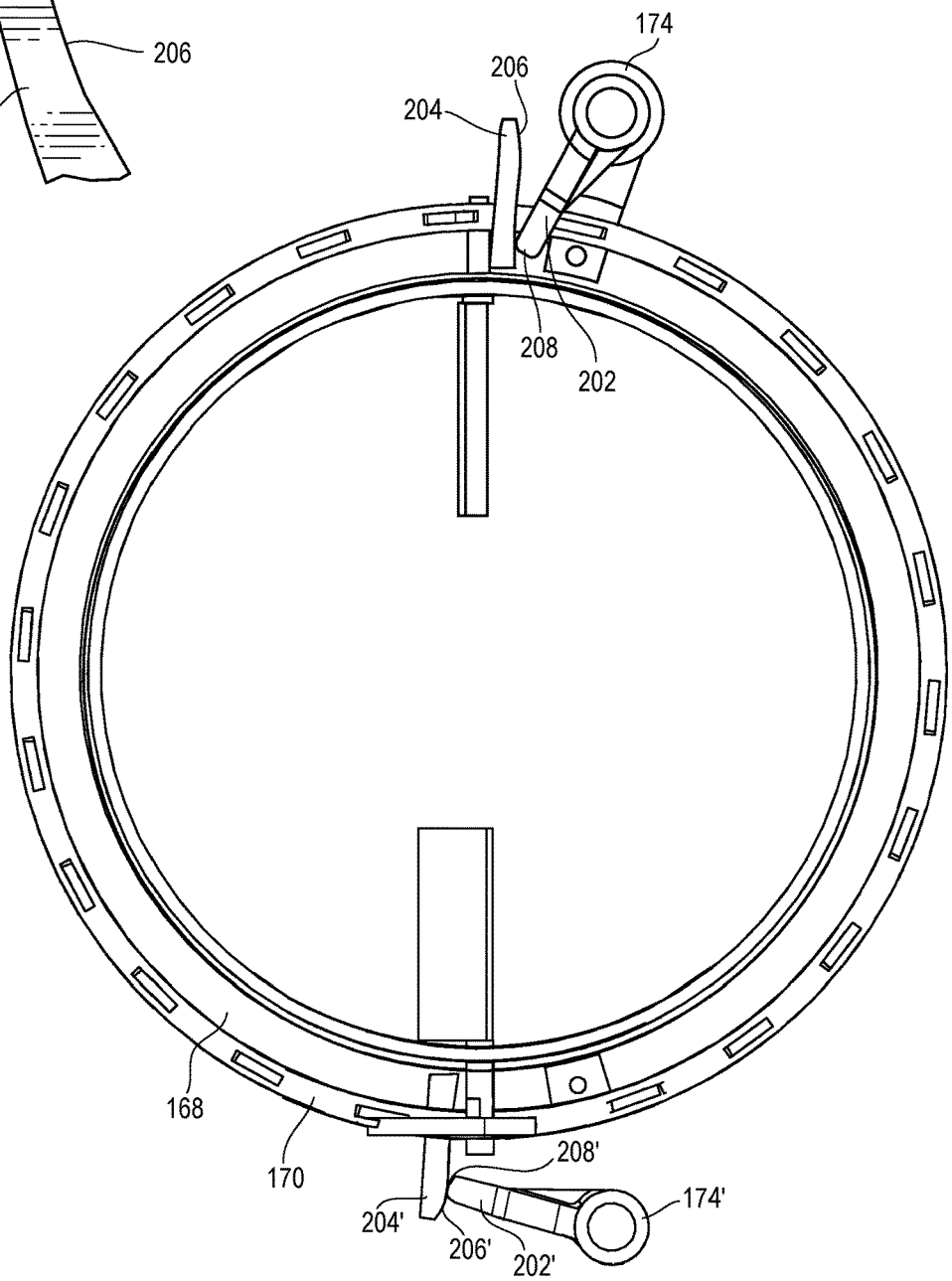
FIG. 8 is an elevational view of the variable vane positioning system of FIGS. 4-6 that employs two torque tubes.

Referring to FIG. 8, in one embodiment, two torque tubes 174 and 174' are used to control each unison ring 170. In an exemplary embodiment, the two torque tubes are disposed on opposite sides of the casing 168. The first torque tube 174 has a first cam 202 secured thereto and a first cam follower 204 is secured to the unison ring 170 as described above. The second torque tube 174' has a second cam 202' secured thereto and a second cam follower 204' secured to the unison ring 170 as described above. The torque tubes 174 and 174' are operated in a complementary manner with respect to one another such that when the first torque tube 174 is operated in a clockwise direction, the second torque tube 174' is operated in a counter-clockwise direction. Arranging the torque tubes 174 and 174', the cams 202 and 202', and the cam followers 204 and 204' in this manner forces the face 206 of the cam follower 204 (204') against the terminal portion 208 of the cam 202 (202') and ensures substantially continued contact therebetween.

In some embodiments, the torque tube 174 may be actuated only when the unison ring 170 is to move in a clockwise direction, and the torque tube 174' may be actuated only when the unison ring 170 is to move in a counterclockwise direction. Alternatively, the torque tube 174 may be actuated only when the unison ring 170 is to move in a counterclockwise direction, and the torque tube 174' may be actuated only when the unison ring 170 is to move in a clockwise direction.

In some embodiments, the profiles of the faces 206 and 206' are identical. In other embodiments, the profiles of the faces 206 and 206' may be different, for example, to have the vane positioning system 200 rotate the vanes 166 coupled to the unison ring 170 in one direction (e.g., clockwise) a different amount or at a different velocity than in an opposite direction (counterclockwise) in response to an identical magnitude and velocity of rotation of the torque tube 174. Similarly, the terminal portions 208 and 208' may have identical or different profiles.

Figure 9:
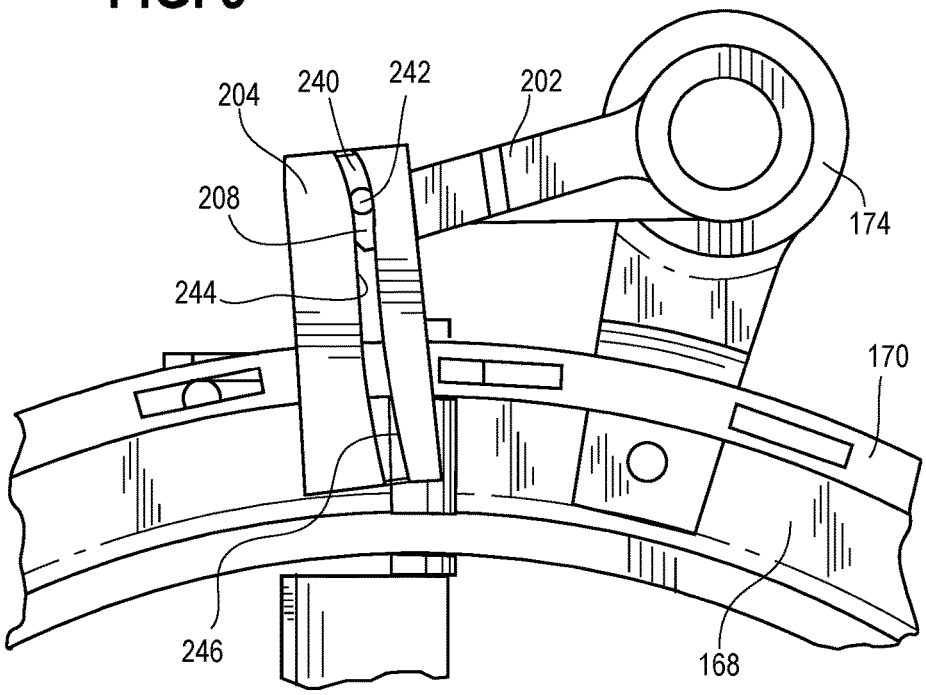
FIG. 9 is an elevational view of an embodiment of a cam and cam follower of the variable vane positioning system of FIGS. 4-6.

Referring to FIG. 9, in another embodiment, the cam follower 204 includes a slot 240 therein. The cam 202 includes rolling element 242 in the terminal portion 208 thereof. The rolling element 242 is captured between walls 244 and 246 of the slot 240 to maintain contact between the cam 202 and the cam follower 204. The rolling element 242 rides along such walls 244 and 246 as the torque tube 174 is rotated. The profiles of the interior faces of the walls 244 and 246 determine the travel distance and velocity of the cam follower 204 (and therefore of the unison ring 170) in response to a particular rotation of the torque tube 174.

Figure 10:
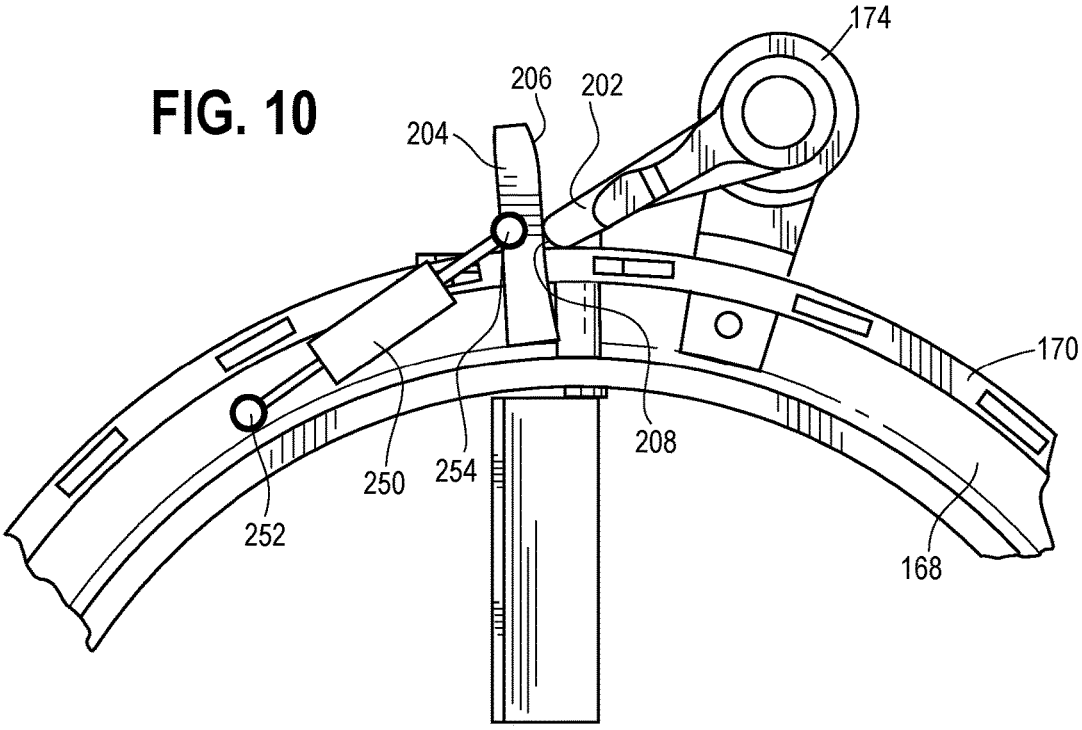
FIG. 10 is an elevational view of the variable vane positioning system of FIGS. 4-6 that employs a spring or piston.

Referring to FIG. 10, in yet another embodiment, a spring 250 is used to maintain contact between the face 206 of the cam follower 204 and the terminal portion 208 of the cam 202. In particular, one end 252 of the spring 250 is secured to the outer casing 168, and another end 254 of the spring 250 is secured to the cam follower 204. The spring 250 is disposed to supply sufficient force to the cam follower 204 to maintain the contact between the cam follower 204 and the cam 202. In one embodiment, the spring 250 provides 500 pounds of force. In some cases, the spring 250 may be replaced with a piston that can supply sufficient force.

It should be apparent that a combination of the embodiments shown in FIGS. 8-10 may be used to maintain contact between the face 206 of the cam follower 204 and the terminal portion 208 of the cam 202.

The variable vane positioning apparatus 200 can be configured as a kit to retrofit a compressor 112 that includes variably positionable vanes controlled by a unison ring and a torque tube. Such a kit would include a cam follower 204 and cam 202 for each unison ring, and fastening hardware to secure the cam 202 to the torque tube 174 and the cam follower 204 to the unison ring 170. As described above, cam followers 204 having faces 206 with different profiles may be provided to select the distance and velocity of travel of the unison ring 170 in response to a particular angular rotation and velocity of the torque tube 174. Some kits may also include an additional torque tube 174' and/or the spring 250 described above in connection with FIGS. 8 and 10.

INDUSTRIAL APPLICABILITY

As should be apparent for the forgoing, the variable vane positioning system 200 provides a number of variables that may be configured to control, in response to a particular amount and speed of rotation of the torque tube 174, the amount of rotation and speed of rotation of the vanes 166 of individual stators 152 relative to other stators of the compressor 112. These variables include the profile of the face 206 of the cam follower 204, the length of the cam 202, the angle at which the cams 202 protrudes from the torque tube 174, and the profile of the terminal portion 208 of the cam 202. These physical features may be selected to customize an aerodynamic schedule of positions of the vanes 166 of the stators 152 of the compressor 112 to optimize the performance of the compressor 112. Such schedule may specify changes in the positions in accordance with, for example, the speed of rotation of the compressor. An engine controller (not shown) or a controller (not shown) associated with the vane positioning system 200 may implement such schedule by rotating the torque tube 174 predetermined amounts, and at predetermined speeds, at different times during operation of the compressor 112.

Having the cam follower and cam paths be different per stator stage allows for independent vane rotational behavior from stage to stage for constant angular movements of a single connected torque tube. This greatly reduces the off-schedule behavior of multiple stator stages without requiring the use of separate independent actuators to control each stage. This reduces OEM weight and cost, increases SFC and/or aircraft range, reduces hydraulic or electrical routing, and reduces maintenance burden.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure

We claim:

1. A variable vane positioning apparatus for controlling the position of a variable vane of a stator in a compressor of a turbine engine, comprising:

a unison ring, wherein the vane is coupled with the unison ring via a vane arm;

a torque tube;

a cam having one end secured to a torque tube and a terminal end opposite the one end;

a cam follower secured to the unison ring, the cam follower having a face with a non-circular profile in contact with the terminal end of the cam;

wherein rotation of the torque tube causes movement of the cam, and movement of the cam moves the cam follower, thereby moving the unison ring and the variable vane coupled thereto.

2. The variable vane positioning apparatus of claim 1, wherein the stator, the unison ring, the cam, and the cam follower comprise a first stator, a first unison ring, a first cam, and a first cam follower, respectively, further comprising:

a second unison ring that controls vanes of a second stator;

a second cam secured to the torque tube;

a second cam follower secured to the unison ring, the second cam follower having a face with a profile in contact with the second cam;

wherein rotation of the torque tube causes movement of the second cam, and movement of the second cam moves the second cam follower, thereby moving the second unison ring.

3. The variable vane positioning apparatus of claim 2, wherein in response to a particular amount of rotation of the torque tube, the first unison ring and the second unison ring move different distances.

4. The variable vane positioning apparatus of claim 2, wherein in response to a particular rotation of the torque tube, the first unison ring and the second unison ring move at different velocities.

5. The variable vane positioning apparatus of claim 1, wherein the cam follower includes a slot, and the wall is an interior wall of the slot.

6. The variable vane positioning apparatus of claim 5, wherein the cam includes a rolling element at the terminal end thereof, and the rolling element is captured in the slot.

7. The variable vane positioning apparatus of claim 1, including a device that applies a force to the cam follower to maintain contact between the wall and the cam.

8. The variable vane positioning apparatus of claim 7, wherein the device is one of another torque tube, a spring, and a piston.

9. The variable vane positioning apparatus of claim 1, wherein the unison ring is moved at a velocity that varies as the torque tube rotates.

10. A method of positioning a variable vane in a compressor of a turbine engine, wherein the variable vane is coupled to a unison ring, comprising:

rotating a torque tube;

in response to rotation of the torque tube, moving a cam having one end secured to the torque tube and a non-circular terminal end opposite the one end;

in response to movement of the cam, moving a cam follower having a face comprising a profile in contact with the non-circular terminal end of the cam, wherein the cam follower is secured to the unison ring; and in response to movement of the cam follower, moving the unison ring and the vane.

11. The method of claim 10, wherein the vane, the unison ring, the cam, and the cam follower comprise a first vane, a first unison ring, a first cam, and a first cam follower, respectively, further comprising:

in response to rotation of the torque tube, moving a second cam secured to the torque tube;

in response to movement of the second cam, moving a second cam follower having a face with a profile in contact with the second cam, wherein the second cam follower is secured to a second unison ring; and in response to movement of the second cam follower, moving the second unison ring and a second vane coupled to the second unison ring.

12. The method of claim 11, wherein in response to a particular amount of rotation of the torque tube, the first unison ring and the second unison ring move different distances.

13. The method of claim 12, wherein in response to a particular rotation of the torque tube, the first unison ring and the second unison ring move at different velocities.

14. The method of claim 10, wherein the cam follower includes a slot, and the wall is an interior wall of the slot.

15. The method of claim 14, including the further step of capturing a rolling element at the terminal end of the cam in the slot.

16. The method of claim 10, further including providing a force to maintain contact between the wall and the cam.

17. The method of claim 16, wherein the force is provided by one of another torque tube, a spring, and a piston.

18. The method of claim 16, further including the step of moving the unison ring at a velocity that varies as the torque tube rotates.

19. A kit for adding a variable vane control to a compressor of a turbine engine, wherein the compressor includes a variable vane coupled to a unison ring, comprising:

a cam follower;

a cam having one end adapted to be secured to a torque tube and a non-circular terminal end opposite the one end; and a fastener to mechanically secure the cam follower to a unison ring and in contact with the cam;

wherein rotation of the torque tube results in a movement of the unison ring via the cam and the cam follower.

20. The kit of claim 19, further including a device that maintains contact between the cam follower and cam during operation of the compressor, the device including one of another torque tube, a spring, and a piston.

* * * * *